United States Patent [19]

Tancs

[11] 4,403,562

[45] Sep. 13, 1983

[54] THREAD PICKER CIRCUIT FOR INDUSTRIAL SEWING MACHINE

[75] Inventor: Tibor L. Tancs, Roselle Park, N.J.

[73] Assignee: The Singer Company, Stamford, Conn.

[21] Appl. No.: 466,258

[22] Filed: Feb. 14, 1983

[51] Int. Cl.[3] ..... D05B 69/22; D05B 65/00

[52] U.S. Cl. ..... 112/275; 112/300

[58] Field of Search ..... 112/275, 277, 285–301

[56] References Cited

U.S. PATENT DOCUMENTS 3,386,402 6/1968 Ross .
3,407,910 10/1968 Heidt .
3,750,603 8/1973 Martin .
4,014,277 3/1977 Morinaga et al. .
4,141,307 2/1979 Okada .
4,160,424 7/1979 Newell et al. ..... 112/275
4,173,193 11/1979 Morinaga et al. ..... 112/300 X

*Primary Examiner*—Peter P. Nerbun
*Attorney, Agent, or Firm*—David L. Davis; Robert E. Smith; Edward L. Bell

[57] ABSTRACT

An industrial sewing machine system having a thread trimmer is provided with an arrangement which generates a signal when the thread is 180° from the needle. At this time, the thread picker is actuated and during the time required for the picker to be properly positioned, the control circuitry for the system is disabled.

2 Claims, 2 Drawing Figures

THREAD PICKER CIRCUIT FOR INDUSTRIAL SEWING MACHINE

DESCRIPTION

BACKGROUND OF THE INVENTION

This invention relates to sewing machines and, more particularly, to an arrangement for actuating a thread picker in an industrial sewing machine.

Industrial sewing machines are commonly equipped with an underbed thread trimming arrangement. Such an arrangement typically includes a thread picker, a thread cutter and a thread wiper. Thread trimming is initiated in response to the sewing machine operator heeling the treadle. The sewing machine is stopped and the thread picker is extended into the needle thread loop and in position to pick up the bobbin thread. The thread picker then pulls the threads past the cutter blade. The needle thread wiper then pulls the needle thread above the presser foot before it is raised.

The timing of the above-described sequence is critical for proper operation. In particular, when the picker is extended, the needle thread must be positioned across the hook precisely 180° from the needle.

It is therefor an object of the present invention to provide a precise timing arrangement for operating a needle thread picker.

SUMMARY OF THE INVENTION

The foregoing and additional objects of this invention are attained by providing an arrangement which responds to a trim signal initiated by the operator heeling and treadle. Using the sewing machine tachometer, a signal is generated when the needle thread is precisely 180° from the needle. At this time the picker is activated and a timer is started. Until the timer times out, the machine is kept stopped and the control circuitry is disabled to insure that the picker moves to its proper position.

BRIEF DESCRIPTION OF THE DRAWING

The foregoing will be more readily apparent upon reading the following description in conjunction with the drawing in which.

DESCRIPTION

Figure 1:
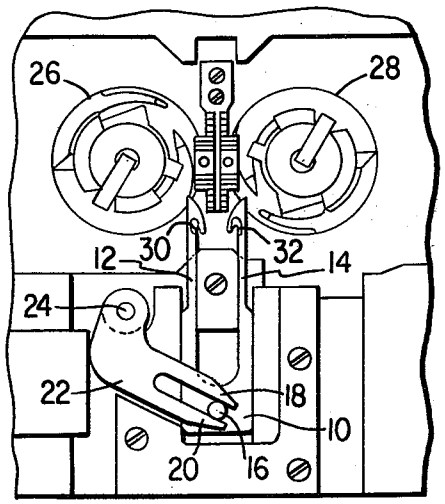
FIG. 1 schematically illustrates the relationship between the hooks and the picker in a double needle industrial sewing machine.

Referring to FIG. 1, shown therein is a view of a double-needle industrial sewing machine to illustrate the relationship between the thread pickers and the hooks. Such an arrangement is well known in the art. The thread picker comprises a bifurcated member 10 having a pair of picker arms 12 and 14. The member 10 has a pin 16 extending upwardly therefrom. The pin 16 is captured between the arms 18, 20 of a bifurcated actuating lever 22, pivoted at 24. As is well known in the art, the actuating lever 22 is caused to rotate, by means of an air cylinder (not shown). The air cylinder is controlled through a solenoid actuated valve (not shown), in a manner well known in the art. When the lever 22 is moved clockwise, as viewed in FIG. 1, the picker member 10 is extended over the hooks 26, 28. Each of the picker arms 12, 14 includes a thread capturing notch 30, 32, respectively. When the actuating lever 22 is returned, the notches 30, 32 pull the threads across a cutter blade to effect a severing operation. In order to insure that the threads are properly captured, the picker member 10 must be extended when the threads extend directly across the hooks, precisely 180° from the needles. The arrangement shown in FIG. 2 accomplishes that objective.

Figure 2:
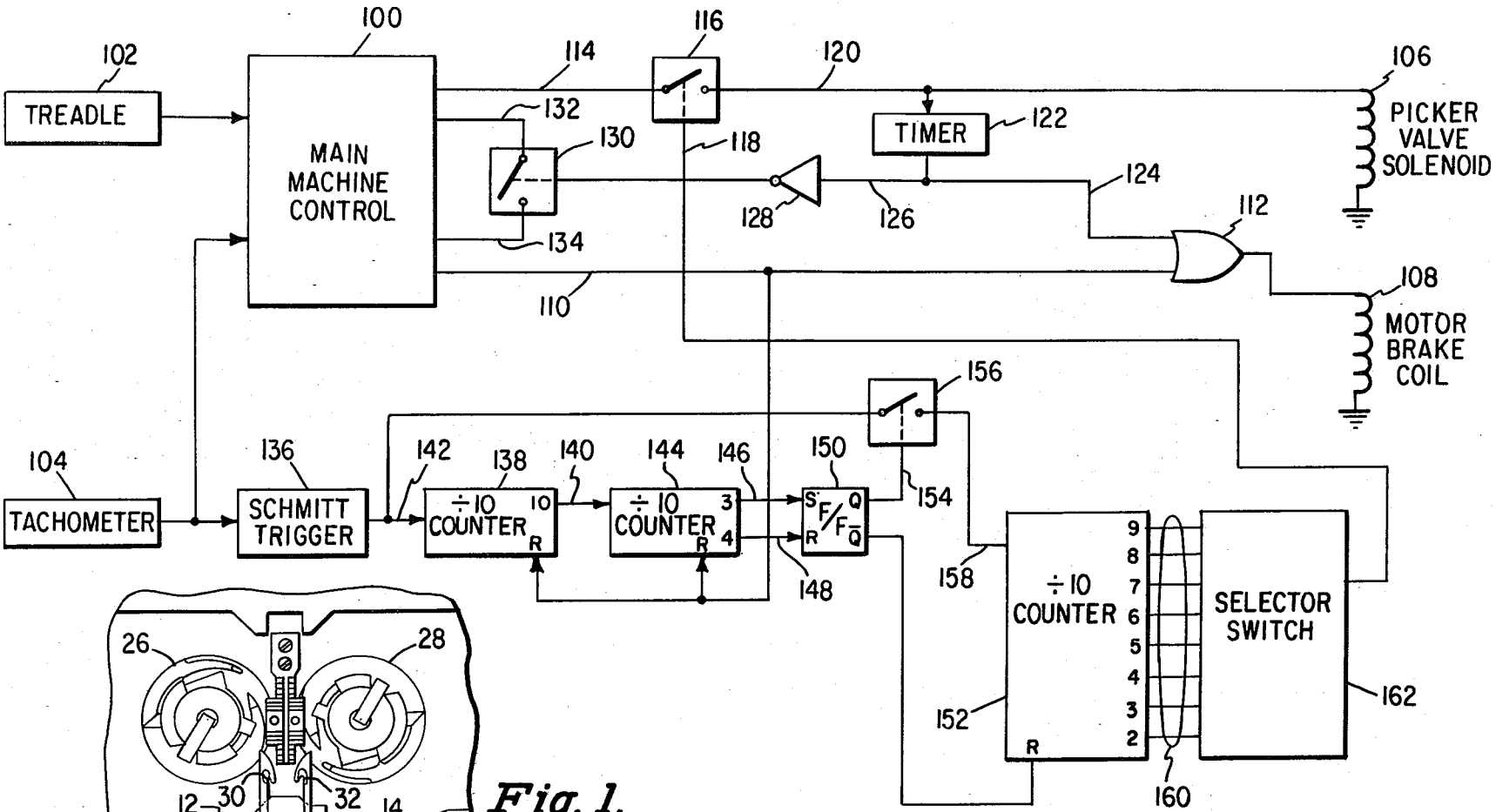
FIG. 2 is a schematic circuit diagram of an illustrative timing and control arrangement constructed in accordance with the principals of this invention.

Referring now to FIG. 2, shown therein is a schematic diagram of electrical circuitry incorporating the principals of this invention. This circuitry is intended to be incorporated in an industrial sewing machine system such as that disclosed in U.S. Pat. No. 4,154,179, the contents of which are hereby incorporated by reference as if fully set forth therein. Accordingly, the industrial sewing machine system includes a main machine control 100 which response to various input signals for sequencing the sewing system through a plurality of internal states and generates output signals for controlling the sewing machine and various devices associated therewith. Illustratively, the main machine control 100 may be implemented by a stored program microcomputer. As shown in FIG. 2, the input devices include a treadle 102 and a tachometer 104. As is well known, a treadle for an industrial sewing machine may be depressed in the forward direction by the operator to cause the sewing machine to run and may be heeled by the operator to cause the sewing machine to stop, perform a back tack operation, and/or a thread trimming operation. In particular, the present invention is concerned with responding to heeling of the treadle 102 to provide the proper timing for effecting a trim operation. The tachometer 104 may be any known device for providing a fixed number of pulses for every complete operating cycle of the sewing machine, the frequency of the pulses corresponding to the speed of operation of the sewing machine. For example, an optical encoder is commonly utilized which includes an opaque disc having a plurality of equally spaced open slits, the disc rotating in synchronism with the main shaft of the sewing machine and the plane of the disc lying between a light emitter and a detector. Illustratively, the tachometer 104 provides 120 pulses for each revolution of the sewing machine shaft. FIG. 2 illustrates two output devices which respond to signals from the main machine control 100. The first of these devices is the picker valve solenoid 106 which functions to control an air valve which in turn controls the operation of an air cylinder for moving the picker 10 (FIG. 1). The other output device illustrated in FIG. 2 is a motor brake coil 108 which is part of an electromagnetically operated brake assembly (not shown) which prevents the sewing machine from operating.

Before describing the details of the operation of the circuitry shown in FIG. 2, it would be helpful to briefly set forth the sequential operation controlled by that circuitry. When the operator heels the treadle 102, indicating that a trim operation is to be performed, the control 100 causes the sewing machine to stop with the needle in the down position. This requires that the motor brake coil 108 be energized. Accordingly, at the appropriate time, as signaled by a needle position sensor (not shown), the control 100 places a signal on the lead 110 which is transmitted through the OR gate 112 to energize the motor brake coil 108. After the sewing machine is stopped, the control 100 initiates the trim sequence and again starts the sewing machine. At this time, a trim signal is applied to the lead 114. However, the normally open condition of a bilateral switch 116 prevents the trim signal on the lead 114 from energizing the picker valve solenoid 106. At the appropriate time, when the thread is 180° from the needle, a signal is applied to the lead 118 to close the switch 116. Accordingly, the trim signal now appears on the lead 120 to perform two functions. The first function is to energize the picker valve solenoid 106. The second function is to start the operation of a timer 122. The timer 122 times an interval sufficient to insure that the picker 10 is fully extended. Illustratively, this interval is 84 milliseconds. During this time interval, the timer 122 applies an output on the lead 124 which is transmitted to the OR gate 112 to energize the motor brake coil 108. At the same time, a signal is applied to the lead 126 which is transmitted through the inverter 128 to cause the bilateral switch 130, which had been closed, to open. The switch 130 is connected to the leads 132 and 134 which form a control loop with the main machine control 100 which responds to the opening of the control loop to cease all operation until the control loop is again closed. This occurs at the end of the time interval, which also deenergizes the motor brake coil 108 and allows the remainder of the trim sequence to be effected.

As shown in FIG. 2, the output of the tachometer 104 passes through a Schmitt trigger circuit 136 and then to the first stage of a counting chain. This first stage comprises a divide-by-ten counter 138 which provides an output on the lead 140 for every tenth pulse at its input 142. This output goes to a divide-by-ten counter 144 which provides an output on the lead 146 when it reaches a count of three and an output on the lead 148 when it reaches a count of four. The output on the lead 146 is applied to the set input of a flip-flop 150 and the output on the lead 148 is applied to the reset input of the flip-flop 150. Accordingly, the flip-flop 150 is set after 30 pulses on the lead 142 and it reset after 40 pulses on the lead 142. The counters 138 and 144 are reset whenever a brake signal is applied to the lead 110. Accordingly, during the trim sequence, the counters 138 and 144 are reset when the sewing machine is initially stopped with it needle in the down position and counting begins when the trim sequence is begun. The third counting stage comprises a divide-by-ten counter 152 which had been reset by the Q output of the flip-flop 150. When the flip-flop 150 is set after 30 pulses on the lead 142 after the trim sequence has begun, its output on the lead 154 closes the bilateral switch 156 so that the pulses on the lead 142 are transmitted to the input 158 of the counter 152. The outputs 160 of the counter 152 go to a selector switch 162. The selector switch 162 provides the capability of selecting any one of its inputs to appear at its output 118. As the system is illustrated in FIG. 2, one of the counts between 32 and 39 may be selected. When this count is reached, the switch 116 is closed to energize the picker valve solenoid 106 and start the timer 122. At the end of the time interval timed by the timer 122, the picker 10 will be in the proper position to trap the threads when the sewing machine is restarted on its way to the needle up position.

The selector switch 162 is adjustable so that an individual sewing machine can be properly set up to insure that the picker is energized when the thread is 180° from the needle. Since the tachometer 104 provides 120 pulses for each revolution, the accuracy of the described system is 3°.

Accordingly, there has been described an improved system for accurately timing the operation of a thread picker in a thread trimmer for use with an industrial sewing machine. It is understood that the above-described arrangement is merely illustrative of the application of the principals of this invention. Numerous other arrangements may be devised by those skilled in the art without departing from the spirit and scope of this invention, as defined by the appended claims. For example, while a double needle sewing machine has been illustrated, this system may also be utilized with a single needle machine.

I claim:

1. Apparatus for operating a thread picker associated with a thread trimmer in a sewing machine comprising:

operator actuated means for generating a trim command signal to initiate a trim operation of said sewing machine;

control means responsive to said trim command signal for stopping said sewing machine with the sewing machine needle at substantially its lowest position, said sewing machine including a mechanical brake activated in response to a brake signal applied thereto, said control means generating said brake signal to stop said sewing machine, said control means further causing said sewing machine to operate after stopping and generating a trim signal to operate said thread picker;

tachometer means operating in synchronism with said sewing machine for generating a fixed number of pulses for every complete operating cycle of said sewing machine, the frequency of said pulses corresponding to the speed of operation of said sewing machine;

counting means for counting said pulses and providing a count output signal upon reaching a predetermined count value;

means responsive to said brake signal generated by said control means for resetting said counting means;

transmitting means responsive to said count output signal for transmitting said trim signal from said control means to said thread picker;

timer means responsive to operation of said transmitting means for timing a predetermined time interval;

means operative during said predetermined time interval for generating said brake signal; and means operative during said predetermined time interval for stopping operation of said control means.

2. The apparatus according to claim 1 wherein said counting means includes means for adjusting said predetermined count value.

* * * * *